US005222511A

United States Patent [19]

Mikkelsen et al.

[11] Patent Number: 5,222,511

[45] Date of Patent: Jun. 29, 1993

[54] APPARATUS FOR DEBAGGING DUST-CONTAINING OR HAZARDOUS MATERIALS

[75] Inventors: Alan R. Mikkelsen, Naperville; Edwin T. Sortwell, Wheaton, both of Ill.

[73] Assignee: Diatec Environmental, Batavia, Ill.

[21] Appl. No.: 719,168

[22] Filed: Jun. 27, 1991

[51] Int. Cl.[5] ..... B08B 3/02

[52] U.S. Cl. ..... 134/62; 134/104.2; 134/200; 312/1

[58] Field of Search ..... 134/104.1, 104.4, 62, 134/200; 55/467; 312/1

[56] References Cited

U.S. PATENT DOCUMENTS

| | | | |
|---|---|---|---|
| 2,107,995 | 2/1938 | Statham et al. | 221/23 |
| 2,706,567 | 4/1955 | Luna et al. | 214/302 |
| 3,145,858 | 8/1964 | Helbig | 214/305 |
| 3,482,718 | 12/1969 | Moriarty | 214/305 |
| 3,739,471 | 6/1973 | Peres | 30/4 R |
| 4,034,877 | 7/1977 | Bennison | 214/305 |
| 4,252,489 | 2/1981 | Mechalas | 414/412 |
| 4,289,438 | 9/1981 | Murer | 414/412 |
| 4,440,185 | 4/1984 | Wiltse | 134/104.4 |
| 4,627,781 | 12/1986 | Borgner | 414/412 |
| 4,798,508 | 1/1989 | Lewis | 414/412 |
| 4,928,440 | 5/1990 | Hughes | 51/426 |
| 4,993,199 | 2/1991 | Hughes | 134/104.4 |
| 5,062,871 | 11/1991 | Lemon, III | 312/1 |
| 5,095,925 | 3/1992 | Elledge et al. | 134/104.1 X |
| 5,097,750 | 3/1992 | Oldham et al. | 55/467 |

*Primary Examiner*—Frankie L. Stinson

*Attorney, Agent, or Firm*—Marshall, O'Toole, Gerstein, Murray & Borun

[57] ABSTRACT

An apparatus for removing dust-containing or hazardous material from bags includes a vertical bag feeding chute having one or more vertically disposed knife blades fixed (no moving mechanical parts) in the chute to slice open the bag as it falls through the chute. The sliced bag is caught in a downwardly angled perforated basket disposed below the bag feeding chute where an operator operating through a glove box removes solid material from the interior of the sliced bag after most of the bag contents have fallen through the perforated receiving basket and into a mixing tank. The apparatus is particularly useful for debagging acrylamide monomer in the production of polyacrylamide homopolymers and copolymers.

15 Claims, 3 Drawing Sheets

APPARATUS FOR DEBAGGING DUST-CONTAINING OR HAZARDOUS MATERIALS

FIELD OF THE INVENTION

The present invention is directed to a method and apparatus for debagging dust-containing or hazardous materials, including method and apparatus for removing solid material from interior surfaces of a bag for complete removal of the contents of the bag and directing all of the bag contents into a holding tank. More particularly, the present invention is directed to a method and apparatus for removing dust-containing or hazardous material from a disposable bag by dropping the bag down a vertical bag-feeding chute that includes one or more fixed knife blades for slicing open the bag without knife blade movement; catching the sliced bag on a perforated receiving basket disposed above a solid or liquid level in a holding or mixing tank so that most of the contents drop downwardly into the holding tank; and washing or blowing entrained material from interior surfaces of the sliced bag and chute so that both the entrained material and any wash liquid used are directed into the mixing tank. When wash liquid is used, the amount of wash liquid can be metered to obtain a precise and relatively accurate determination of the final concentration of the debagged material in the liquid combined therewith in the mixing tank.

BACKGROUND OF THE INVENTION AND PRIOR ART

It is well known to provide apparatus capable of opening and substantially emptying bags of particulate, powdered or pulverulent materials particularly for toxic or hazardous materials, to aid in the speed of production in a process using such materials, and especially for debagging hazardous materials to prevent or minimize human contact during operation and mechanical maintenance with the contents of the bag and to attempt to remove all of the material from the bag. Examples of patents directed to mechanical debagging apparatus are as follows: U.S. Pat. Nos. 2,107,995, Statham, et al.; 2,706,567, Luna, et al.; 3,145,858, Helbig; 3,482,718, Moriarty; 3,739,471, Peres; 4,034,877, Bennison; 4,252,489, Mechalas; 4,289,438, Murer; 4,627,781, Borgner; 4,798,508, Lewis.

While the apparatus described in the above-identified patents are useful for debagging and removing most dust-containing and hazardous substances, such apparatus suffers from one or more of the following disadvantages: debagging apparatus used for debagging toxic and hazardous materials should not have a bag opening means that includes moving parts since some of the toxic or hazardous material may become clogged in an area of mechanical movement during operation, making operation and maintenance hazardous; many of the above-described debagging apparatus do not include a rinsing mechanism whereby dust-containing or hazardous materials remaining or entrained within the bag after substantially complete emptying can be carefully rinsed by hand, applying liquid essentially only to interior, usually plastic-lined surfaces of the bag to ensure that essentially all of the bagged material is rinsed from the bag and directed, together with rinse liquid, into a mixing tank without absorption of water-soluble material and rinse water onto an absorbent exterior bag surface; and the above-described apparatus do not include a metered wash liquid supply such that by rinsing an interior surface of the bag with rinse liquid, essentially all of the rinsed bag contents, as well as a known quantity of rinse liquid, are directed into a mixing tank for further processing. These and other disadvantages of prior art bag opening and emptying apparatus have been overcome in accordance with the method and apparatus of the present invention.

SUMMARY OF THE INVENTION

In brief, the apparatus of the present invention removes dust-containing or hazardous material from bags, and includes a vertical bag feeding chute having one or more vertically disposed knife blades fixed in the chute to slice open the bag as it falls through the chute. The sliced bag is caught in a downwardly angled perforated basket disposed below the bag feeding chute where an operator removes solid material from the interior of the sliced bag with a fluid (liquid or gas) after most of the bag contents have fallen through the perforated receiving basket and into a mixing tank. Any wash liquid used can be metered so that the amount of wash liquid used (1) for rinsing entrained material from the interior surfaces of the bag and perforated basket and (2) for washing the inner surfaces of the bag feeding chute, including knife blades, is measured on each occasion so that the concentration of the bag contents in the mixing tank is always known. While the apparatus of the present invention is particularly useful for debagging acrylamide monomer in the production of polyacrylamide homopolymers and copolymers, the apparatus is useful for debagging, and optionally mixing with liquid, any bagged, dust-containing, hazardous or toxic solid material.

Accordingly, one aspect of the present invention is to provide an apparatus for debagging dust-containing, toxic or hazardous solid materials including removing solid material from an interior surface of the bag with a fluid while directing the bag contents into a holding vessel.

Another aspect of the present invention is to provide an apparatus for debagging dust-containing, toxic or hazardous material without human contact of the debagged material using fixed knife blades, providing a very greatly reduced maintenance exposure (no moving parts) in a bag-receiving chute disposed above a holding tank, while maintaining a negative pressure through the chute and holding tank, and including a glove-box worker station adapted for manual removal of solid material from interior bag surfaces with a fluid so that entrained material falls vertically by gravity into a mixing vessel.

Still another aspect of the present invention is to maintain a negative pressure within a chute and holding tank to ensure all freely dispersed dust in the air will be drawn into the chute and holding tank. Air drawn out of the apparatus to generate the negative pressure is passed through a wet scrubber device.

The above and other aspects and advantages of the present invention will become apparent from the following detailed description of the preferred embodiments of the present invention taken in conjunction with the drawings.

DETAILED DESCRIPTION OF THE PREFERRED EMBODIMENT

Figure 1:
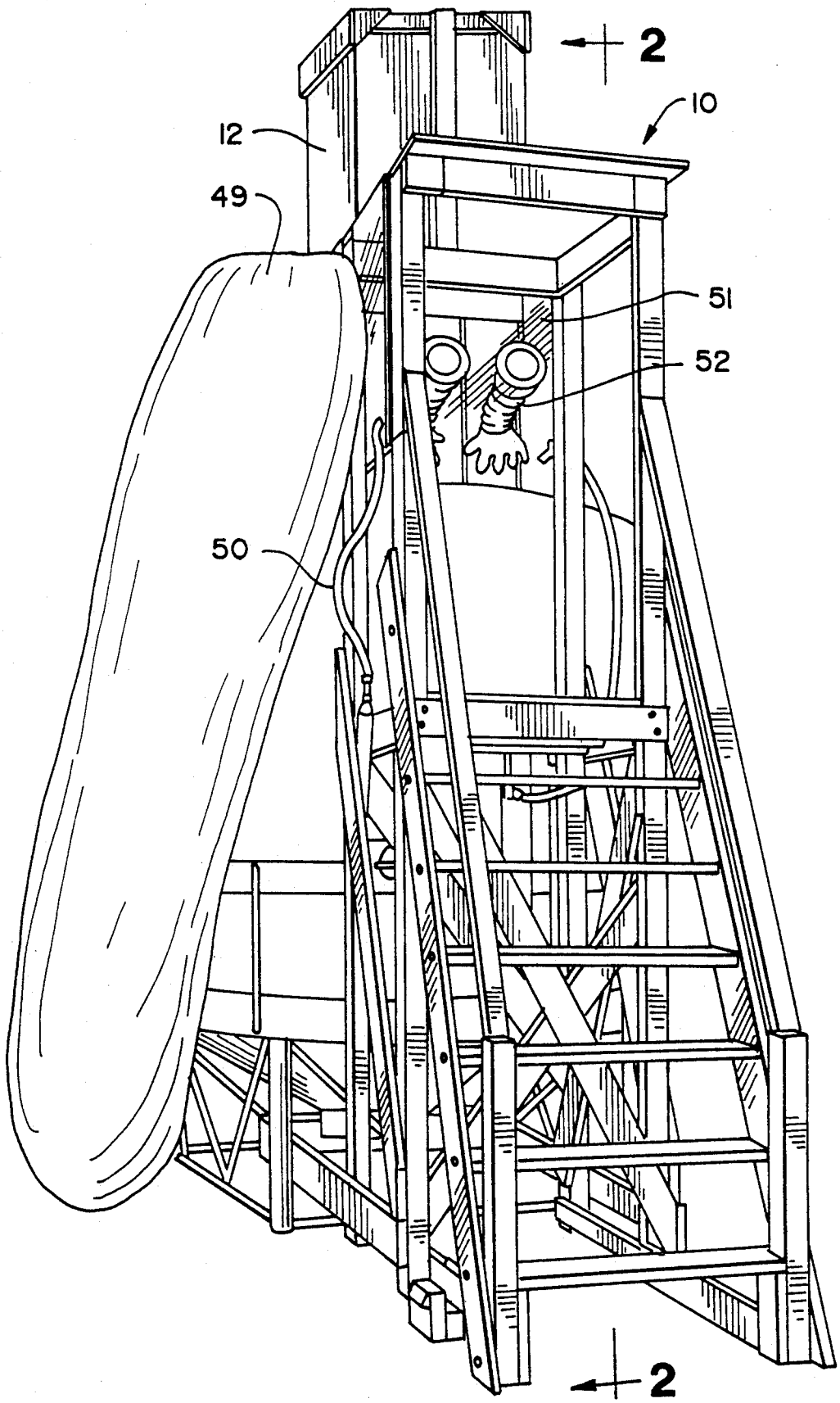
FIG. 1 is a perspective view of the apparatus of the present invention.
Figure 2:
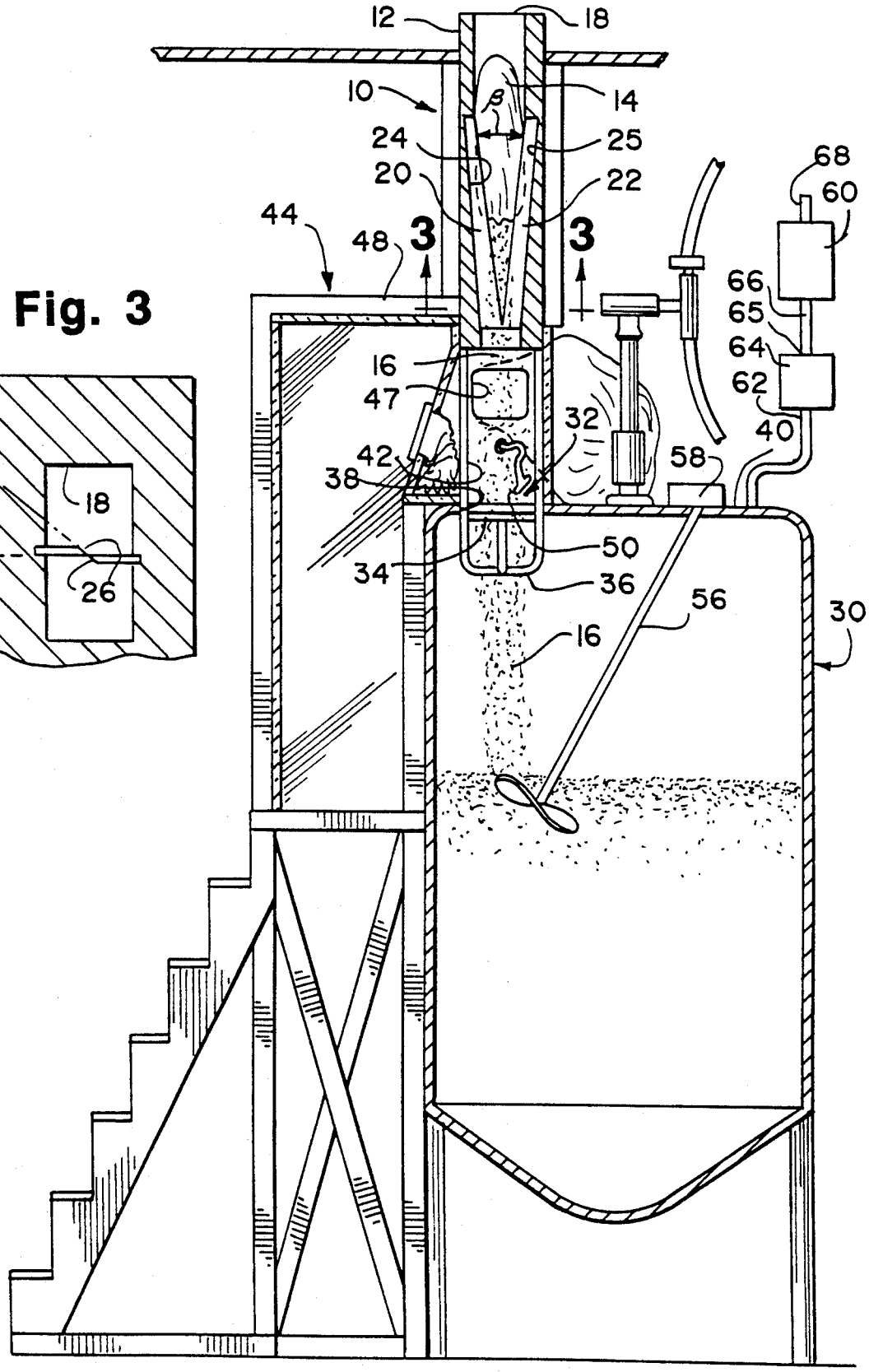
FIG. 2 is a side view of the apparatus of FIG. 1 taken along the line 2—2 of FIG. 1.
Figure 3:
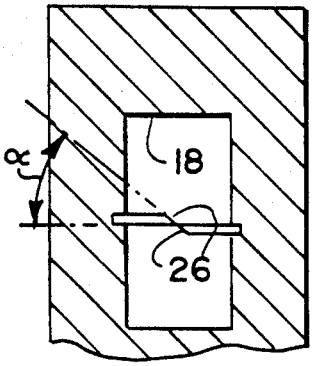
FIG. 3 is a top view of the blade box portion of the apparatus taken along the line 3—3 of FIG. 2.

Turning now to the drawings and initially to FIGS. 1 and 2, there is shown an apparatus for debagging dust-containing or hazardous materials generally designated by reference numeral 10. The apparatus includes an enclosure or blade box, generally designated by reference numeral 12, for directing a bag 14 of particulate solid material 16 downwardly from an uppermost blade box opening 18 for engagement with a pair of slicing blades 20 and 22, each fixed to an opposed inner surface 24 or 25 of the blade box 12. As best shown in FIG. 3, the slicing blades 20 and 22 extend inwardly from the opposed inner surfaces 24 and 25, respectively, of the blade box 12, each beveled at 26 such that the beveled portions 26 of the opposed knife blades 20 and 22 lie in the same plane to achieve relatively dust-free and clean bag slicing. The slicing blades 20 and 22 extend downwardly and inwardly toward a transverse center of the enclosure or blade box 12 for gradually and cleanly slicing open the bag 14 of particulate material 16. The blades 20 and 22 may overlap at a transverse center 26, e.g. one half inch, to slice the bag into two halves. The bevel angle, $\alpha$, (FIG. 3), of the blades 20 and 22 is not critical and the bevel generally is provided at an angle of about 30° to about 50°. As shown in FIG. 2, the slicing blades 20 and 22 converge and meet at the transverse center of the blade box 12 to slice the bag 14 into two pieces. As shown in the drawings, the opening 18 in the blade box 12 of the preferred embodiment is eight inches by twenty-seven and one half inches and each blade 20 and 22 is sixty inches long, five inches wide and one half inch thick, to provide an angle, $\beta$ between the slicing blades 20 and 22 of about 8°. Best results are achieved with an acute angle, $\alpha$, e.g. 5°-30°, between the slicing blades 20 and 22.

In accordance with an important feature of the present invention, the slicing blades 20 and 22 are fixedly secured to inner opposed downwardly and inwardly inclined surfaces 24 and 25 of the enclosure or blade box 12 to slice open the bag 14 without any moving parts. The provision of slicing blades 20 and 22 fixed to interior opposed surfaces 24 and 25 of blade box 12 without moving mechanical parts is important to prevent the particulate material 16 from being caught between moving mechanical parts to make sure that the particulate material 16 within the bag 14 is completely emptied from the bag 14 and that all of the particulate material 16 proceeds downwardly into a holding tank 30 so that the amount or concentration of the particulate material 16 within the holding tank 30 is always known. This also greatly reduces the need for maintenance and the potential of toxic/chemical exposure.

Figure 5:
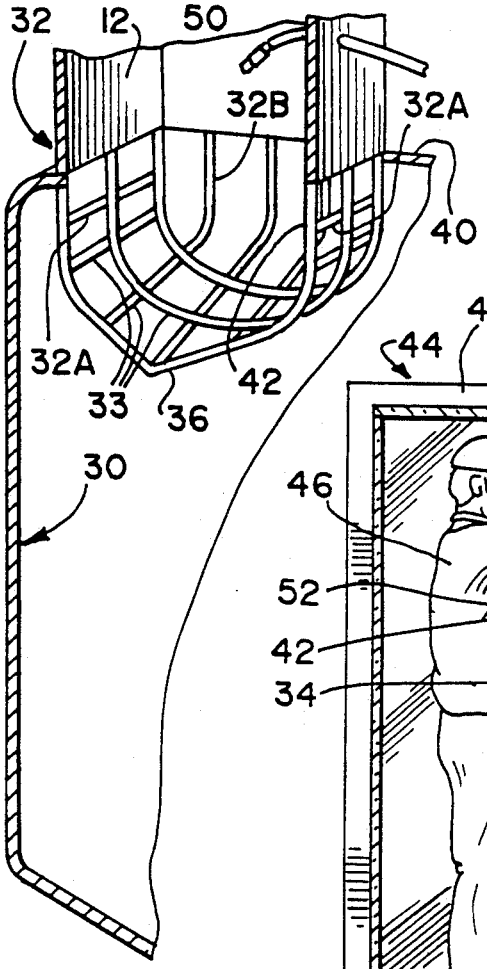
FIG. 5 is a more detailed, partially broken away view of a perforated, bag-receiving basket portion of the apparatus of the present invention.
Figure 4:
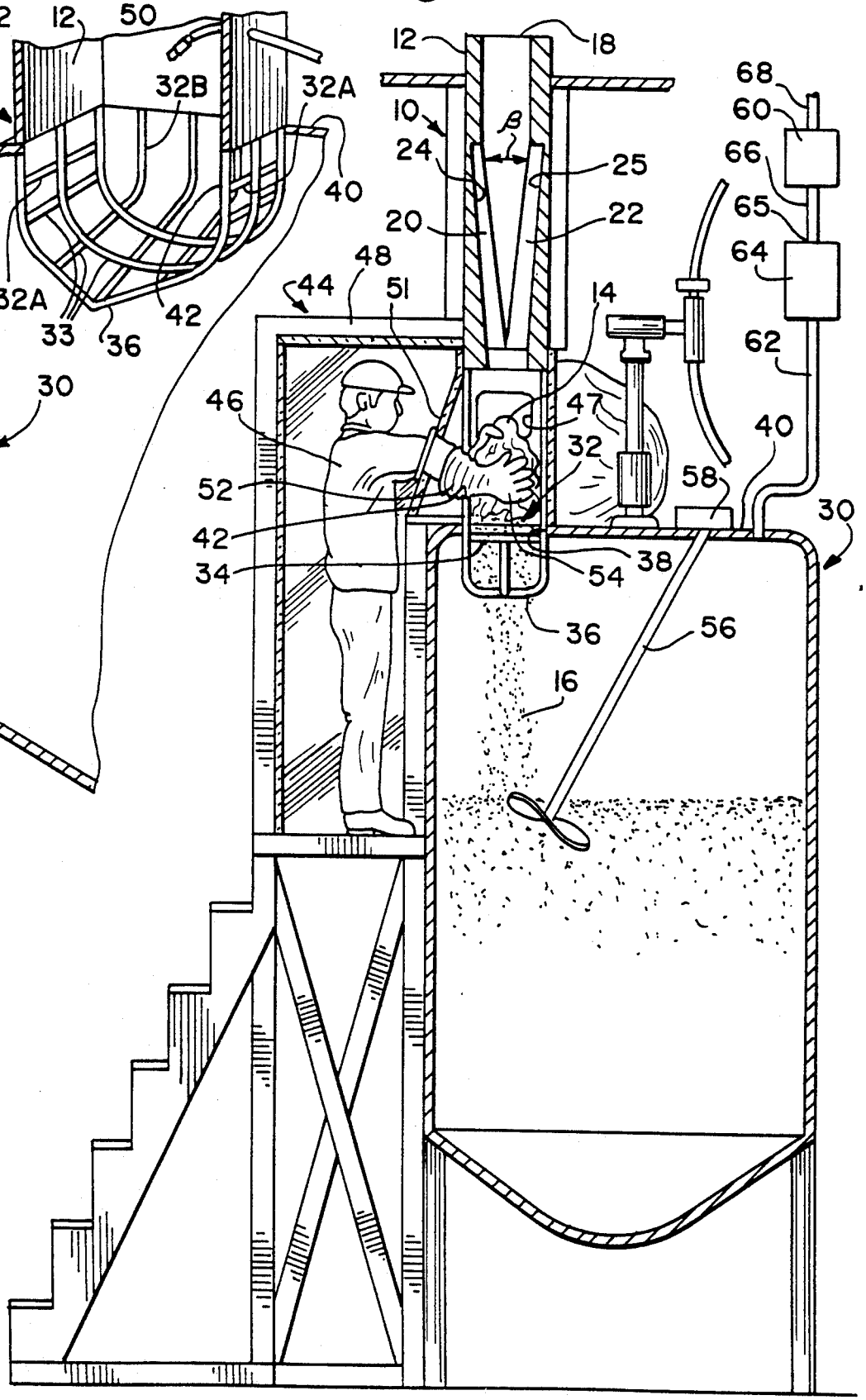
FIG. 4 is a side view of the apparatus of FIG. 1, similar to FIG. 2, showing a worker stationed in a glove box for rinsing the interior of sliced bags, rinsing the apparatus, and disposing of the bags.

A downwardly angled perforated basket best shown in FIGS. 4 and 5, generally designated by reference numeral 32, is disposed beneath the slicing blades 20 and 22 such that an upper portion 34 of the perforated basket is mounted to the enclosure or blade box 12 and a lower, downwardly angled perforated bottom 36 of the basket 32 is disposed within the holding tank 30, extending within the holding tank 30 through a sealed upper opening 38 in an upper surface 40 of the holding tank 30. The downward angling of the bottom 36 of the basket 32 essentially empties the contents of the bag as the bag halves partially rotate during impact of one bag half on each side of the downwardly angled bottom 36 of basket 32.

After the bag 14 is sliced open by the slicing blades 20 and 22, the opened bag 14, together with the particulate material 16, proceeds downwardly by gravity toward the downwardly angled bottom 36 of the perforated basket 32. The perforated basket 32 is formed from a plurality of rods 33 that are secured together at points of intersection, such as by welding, to form two side walls 32A, and a back wall 32B, integral with the downwardly angled bottom wall or floor 36, leaving the top open for receiving a sliced bag, and leaving the front 42 open for a worker to grasp and rinse the inner surfaces of each bag, remove the bags and deposit the empty bags into a waste container or plastic tube 49, disposed proximate to the open front of basket 32. Each bag half contacts an opposite side wall 32A of basket 32 and each bag half rotates by gravity upon impact to substantially completely empty each bag half through the bottom wall 36 of basket 32. The basket 32 is disposed directly beneath the chute 12 and open at its top so that the basket 32 receives a sliced bag of material 14 that comes to rest on the downwardly angled floor 36. The open top of basket 32 is sized and shaped to correspond with a lower end of chute 12 so that all material 16 from bag 14 falls through the basket 32 and into the mixing tank 30. The round cross section of the rods 33 prevent any particulate material 16 from substantially adhering to the basket 32.

The perforations within the downwardly angled bottom 36 of basket 32 are sufficiently large such that the particulate and compacted material 16 passes through the angled bottom 36 of the basket 32; the impact breaks up relatively large agglomerates of material into smaller lumps; and the perforations are sufficiently small such that the bag 14 is retained by the basket 32 for manual solids removal and disposal, as will be described in more detail hereinafter. As best shown in FIGS. 4 and 5, a front portion of the basket 32 includes an open area 42 communicating with a glove box 48 adapted for manually grasping of the bag 14 and removal of solids from interior bag surfaces with a wash liquid or gas and for bag removal and disposal performed from an open front area 42 of the basket 32.

In accordance with an important feature of the present invention, a work station, generally designated by reference numeral 44, is disposed adjacent to the open area 42 of the perforated basket 32 for positioning a worker 46 within an environmentally safe glove box, generally designated by reference numeral 48, so that the worker 46 can rinse an interior surface of the bags 14, remove and dispose of the bags 14 through an adjacent, impervious disposal receptacle window 47, e.g., into an elongated plastic tube or bag 49, without contacting the particulate material 16.

In accordance with another feature of one embodiment of the present invention, a metered water supply, such as water from flexible hose 50, is disposed in close proximity to the perforated basket 32, outside of the glove box 48, and extends within the basket 32 for use by worker 46 to rinse the blades 20 and 22, interior surfaces 24 and 25 of the blade box 12, and metal rods 33 forming the basket 32. The glove box 48 includes a transparent wall 51 adjacent to and facing the open area 42 of the perforated basket 32 so that the worker 46 can insert his hands in flexible sleeves 52 and gloves 54, hermetically sealed to the transparent wall 51 for grasping, washing, and disposing of the washed bags 14 by inserting the rinsed bags 14 into the disposal bag 49 via window 47, without contacting the contents 16 of bag 14, after thoroughly washing the interior surfaces of the bags 14. If necessary, the worker 46 can also wash the interior of the blade box 12 and the slicing blades 20 and 22. All wash or rinse liquid falls into the holding vessel 30 together with all rinsed particulate material 16. The wash liquid supply hose 50 includes a remotely mounted meter (not shown) capable of measuring the amount of rinse liquid that passes through the hose 50 so that the operator 46 is, at all times, aware of the amount of rinse liquid falling by gravity into the holding vessel 30. In this manner, a precise and accurate determination of the concentration of particulate material 16 within the holding vessel 30 is known after rinsing of entrained particulate material is complete. Alternatively, if the solid material is not combined with liquid, a gas, e.g., air, can be supplied from hose 50 for removal of solids from the interior bag surfaces and from the blade box 12 and the slicing blades 20 and 22.

As best shown in FIGS. 1 and 4, the glove box 48 is disposed to completely surround the basket 32 prevent the escape of any particulate material into the surrounding atmosphere. A mixing blade 56 driven by motor 58 optionally extends into holding tank 30 for homogeneously mixing of solid materials with liquid in tank 30.

As best shown in FIGS. 2 and 4, a gas (via liquid media) scrubber 64 is mounted on the upper surface 40 of the holding vessel 30 in sealed, vapor communication with the interior of the holding vessel 30 via a conduit 62, and a blower or vapor pump 60, in vapor communication with a scrubber outlet 65, through a conduit 66, draws air through the bag feeding chute or blade box 12 and into the holding vessel 30 to maintain a negative pressure through the apparatus. Any toxic vapors that pass into the scrubber 64 are neutralized, e.g., with sodium metabisulfite, and non-toxic vapors proceed through a blower outlet conduit 68 to the atmosphere.

While the preferred embodiment of the present invention has been described with reference to the debagged material falling into a liquid holding or mixing tank 30, the method and apparatus are equally applicable to debagging materials that are kept dry, such as sugar, flour and other dusty materials whether or not the materials are hazardous or toxic. In the case of dry materials, entrained solids can be blown from the blade box 12, the blades 20 and 22 and from the rods 33 forming the basket 32 using compressed air or other pressurized gas instead of using a water wash. The dust then can be collected in a standard dry dust filtering media, as is well known in the art.

It should be understood that the present disclosure has been made only by way of the preferred embodiment and that numerous changes in details of construction, combination and arrangement of parts can be resorted to without departing from the spirit and scope of the invention as hereunder claimed.

What is claimed is:

1. Apparatus for removing dust-containing or hazardous material from bags comprising (a) a vertical bag feeding chute including at least one vertically disposed knife blade fixed in said chute and adapted to slice open and separate said bag into two individual sections as it falls through said chute;

(b) a perforated receiving basket disposed below said bag feeding chute to receive said blade-sliced bag;

(c) means for thoroughly removing material from interior surfaces of said sliced bag; and, (d) a holding tank disposed below said receiving basket for receiving the contents of said bag.

2. The apparatus of claim 1 wherein said means of includes:

(e) wash liquid supply means for washing said bag feeding chute, said receiving basket and said sliced bag while directing said wash liquid and material washed from the interior of said slit bag into said holding tank to form a liquid/solid mixture and to control the concentration of said liquid/solid mixture therein; and (f) means for determining the amount of wash liquid supply directed into said holding tank.

3. Apparatus according to claim 1 further including negative pressure means for maintaining a negative pressure within said apparatus to eliminate dust generation around the apparatus.

4. Apparatus according to claim 3 further including a scrubber in fluid communication with the negative pressure means for removing contaminants from gas removed from the apparatus by the negative pressure means.

5. Apparatus according to claim 1 further including glove box means for protecting a worker from the contents of said bags.

6. Apparatus according to claim 5 wherein the negative pressure means comprises a blower in fluid communication with the holding tank for the downward flow of gas through the feeding chute, basket and out of the holding tank.

7. Apparatus according to claim 1 wherein a bottom of said receiving basket includes a downwardly angled perforated bottom such that the basket facilitates discharge of the open bag sections to aid in emptying the contents of said bag.

8. Apparatus according to claim 1 wherein said knife blades slice said bags without knife blade movement.

9. Apparatus for removing dust-containing or hazardous material from bags comprising (a) a vertical bag feeding chute including at least one vertically disposed knife blade fixed in said chute and adapted to slide open and separate said bag into two individual sections as it falls through said chute;

(b) a perforated receiving basket disposed below said bag feeding chute to receive said blade-sliced bag;

(c) a holding tank disposed below said receiving basket for receiving the contents of said bag;

(d) wash liquid supply means for washing said bag feeding chute, said receiving basket and said sliced bag while directing said wash liquid and material washed from the interior of said slit bag into said holding tank to form a liquid/solid mixture and to control the concentration of said liquid/solid mixture therein; and (e) means for determining the amount of wash liquid supply directed into said holding tank.

10. Apparatus according to claim 9 further including negative pressure means for maintaining a negative pressure within said apparatus to eliminate dust generation around the apparatus.

11. Apparatus according to claim 10 further including a scrubber in fluid communication with the negative pressure means for removing contaminants from gas removed from the apparatus by the negative pressure means.

12. Apparatus according to claim 9 further including glove box means for protecting a worker from the contents of said bags.

13. Apparatus according to claim 12 wherein the negative pressure means comprises a blower in fluid communication with the holding tank for the downward flow of gas through the feeding chute, basket and out of the holding tank.

14. Apparatus according to claim 9 wherein a bottom of said receiving basket includes a downwardly angled perforated bottom such that the basket facilitates discharge of the open bag sections to aid in emptying the contents of said bag.

15. Apparatus according to claim 9 wherein said knife blades slice said bags without knife blade movement.

* * * * *

UNITED STATES PATENT AND TRADEMARK OFFICE

CERTIFICATE OF CORRECTION

PATENT NO. : 5,222,511

DATED : June 29, 1993

INVENTOR(S) : Alan R. Mikkelsen, et al

It is certified that error appears in the above-indentified patent and that said Letters Patent is hereby corrected as shown below:

Column 5, Line 31, insert --to-- between "32" and "prevent".

Column 6, Lines 14-15, Claim 2, insert --(c)-- between "of" and "includes".

Signed and Sealed this

Eighteenth Day of October, 1994

*Attest:*

Bruce Lehman

BRUCE LEHMAN

*Attesting Officer*

*Commissioner of Patents and Trademarks*